United States Patent [19]

Weinman et al.

[11] Patent Number: 4,867,729

[45] Date of Patent: Sep. 19, 1989

[54] ANGEL DOLL HAVING MOVABLE WINGS

[76] Inventors: Mary Weinman, 6141 Broadway, Bronx, N.Y. 10471; George Spector, 233 Broadway RM 3815, New York, N.Y. 10007

[21] Appl. No.: 33,618

[22] Filed: Apr. 3, 1987

[51] Int. Cl.[4] ..... A63H 3/20

[52] U.S. Cl. ..... 446/330; 446/268

[58] Field of Search ..... 446/330, 359, 334, 336, 446/298, 300, 337, 268

[56] References Cited

U.S. PATENT DOCUMENTS 3,094,331 6/1963 Greene ..... 446/330 X 4,307,533 12/1981 Sims et al. ..... 446/365 X 4,571,206 2/1986 Mayer et al. ..... 446/330

4,666,419 5/1987 Droller et al. ..... 446/330

FOREIGN PATENT DOCUMENTS 476252 12/1937 United Kingdom ..... 446/365

*Primary Examiner*—Mickey Yu

[57] ABSTRACT

A doll with angel wings is provided and includes wings that are hinged together and hooked into back of the doll body. In a modification a mechanism is provided within the doll whereby when the doll head is pressed down one of the wings will move.

1 Claim, 1 Drawing Sheet

ANGEL DOLL HAVING MOVABLE WINGS

BACKGROUND OF THE INVENTION

The instant invention relates generally to dolls and more specifically it relates to a doll with angel wings.

Numerous dolls have been provided in prior art that are adapted to be fabricated into many different forms. While these units may be suitable for the particular purpose to which they address, they would not be as suitable for the purposes of the present invention as heretofore described.

SUMMARY OF THE INVENTION

A primary object of the present invention is to provide a doll with angel wings that will overcome the shortcomings of the prior art devices.

Another object is to provide a doll with angel wings in which the wings are hinged together and hooked into back of a doll body.

An additional object is to provide a doll with angel wings whereby when doll head is pressed down at least one of the wings will move.

A further object is to provide a doll with angel wings that is simple and easy to use.

A still further object is to provide a doll with angel wings that is economical in cost to manufacture.

Further objects of the invention will appear as the description proceeds.

To the accomplishment of the above and related objects, this invention may be embodied in the form illustrated in the accompanying drawings, attention being called to the face, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
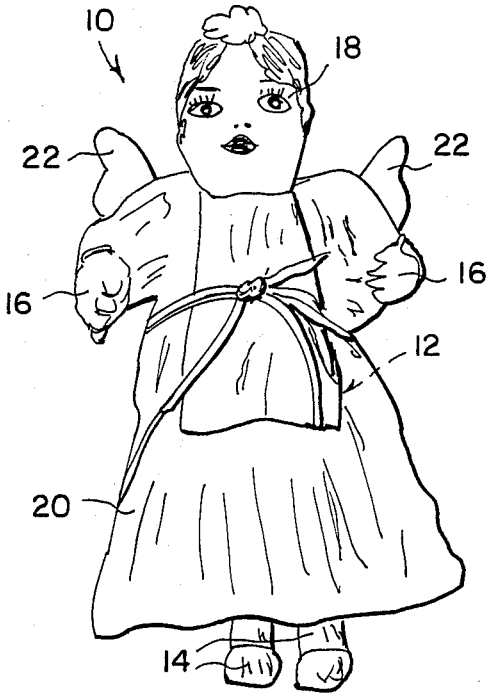
FIG. 1 is a front view of the invention
Figure 2:
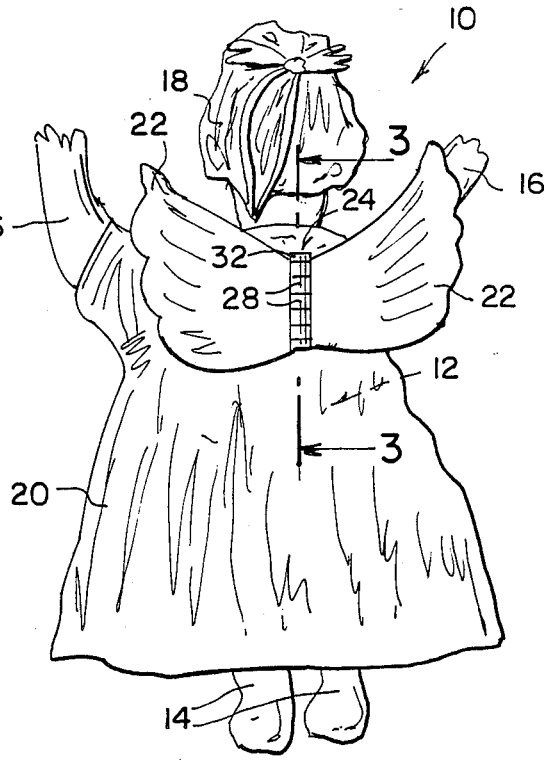
FIG. 2 is a rear view thereof.
Figure 3:
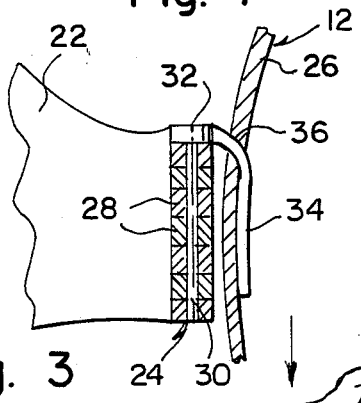
FIG. 3 is a cross sectional view taken along line 3—3 in FIG. 2 showing the hinged angel wings connected to back of doll body.

Turning now descriptively to the drawings, in which similar reference characters denote similar elements throughout the several views, FIGS. 1 to 3 illustrate an angel doll 10 consisting of a doll body 12 having a pair of legs 14, a pair of arms 16 and a head 18. An angel garment 20 is worn on the doll body 12. A pair of pivotable angel wings 22 are provided with a structure 24 for attaching the angel wings 22 in back 26 of the doll body 12. The angel wings 22 have knuckles 28 integrally formed at interconnecting ends thereof. The attaching structure 24 is a pin 30 that has a head 32 with a hook portion 34 thereon. The pin 30 is disposed through the knuckles 28 of the angel wings 22 so that the knuckles of the angel wings can pivot around the pin 30. The hook portion 34 can be inserted within a slot 36 in the back 26 of the doll body 12.

Figure 4:
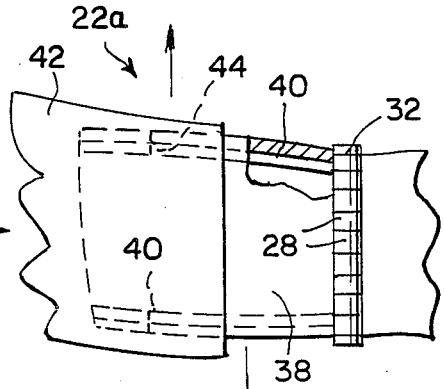
FIG. 4 is a rear view with parts broken away of a modification whereby the angel wings are adjustable.

FIG. 4 shows an adjustable doll wing 22a that includes a first segment 38 that has a pair of spaced apart internal spring arms 40 extending tranversely from the knuckles 28. A second slidingly adjustable segment 42 has a hollow chamber 44 being of a size to receive the first segment 38 with the spring arms 40 bending outwardly for structural support and retention in chamber 44.

Figure 5:
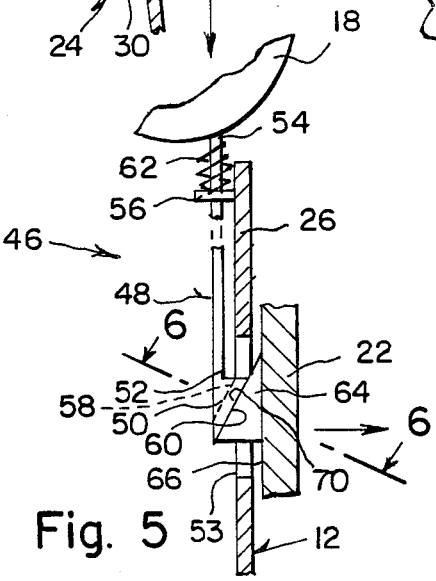
FIG. 5 is a cross sectional view with parts broken away of a mechanism whereby when doll head is pressed down one of the angel wings will move.
Figure 6:
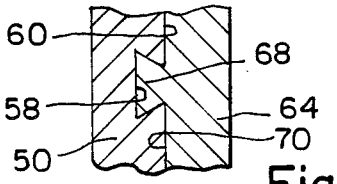
FIG. 6 is an enlarged cross sectional view taken along line 6—6 in FIG. 5 showing the interlocking tongue and groove in the wedges.

FIG. 5 shows a mechanism 46 for moving one of the angel wings 22 when the doll head 18 is manually pressed down. The mechanism 46 includes a shat 48 that has a first wedge 50 at lower end 52 extending through an aperture 53 in the back 26 of the doll body 12 and upper end 54 affixed to the doll head 18. The shaft 48 is slideably affixed at bracket 56 to interior of the back 26 of the doll body 12. The first wedge 50 has a groove 58 through angular edge 60 thereof (see FIG. 6). A spring 62 is provided on the shaft 48 to bias the shaft 48 upwardly at bracket 56. A second wedge 64 is affixed to a back 66 of one of the angel wings 22. The second wedge 64 has a tongue 68 on angular edge 70 thereof (see FIG. 6). The tongue 68 interlocks within the groove 58 in the first wedge 50 so that when the doll head 18 is manually pressed down the wing 22 will move.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An angel doll comprising:

(a) a doll body having a head and back;

(b) a pair of pivotable wings; and (c) means for pivotally attaching said wings to said back of said doll body; wherein said wings each having interfitting knuckles and said attaching means being a pin having a head with a hook portion thereon, said pin disposed through said knuckles of said angel wings so that said knuckles of said angel wings can pivot around said pin and said hook portion can be inserted within a slot in said back of said doll body, in combination with means for moving each of said wings in response to manipulation of said doll head.

* * * * *